US005160159A

United States Patent [19]

Gorza et al.

[11] Patent Number: 5,160,159

[45] Date of Patent: Nov. 3, 1992

[54] SAFETY FASTENING, PARTICULARLY FOR SKIS

[75] Inventors: Roberto Gorza, Feltre; Giorgio Baggio, San Martino Di Lupari; Mirco Battistella, Breda Di Piave, all of Italy

[73] Assignee: Nordica S.p.A., Montebelluna, Italy

[21] Appl. No.: 669,151

[22] Filed: Mar. 14, 1991

[30] Foreign Application Priority Data

Mar. 21, 1990 [IT] Italy ..... 82541 A/90
Oct. 17, 1990 [IT] Italy ..... 82629 A/90

[51] Int. Cl.[5] ..... A63C 9/084
[52] U.S. Cl. ..... 280/632; 280/634
[58] Field of Search ..... 280/631, 632, 633, 634, 280/623, 626

[56] References Cited

U.S. PATENT DOCUMENTS

| | | | |
|---|---|---|---|
| 3,620,545 | 11/1971 | Korger et al. | 280/633 X |
| 3,733,082 | 5/1973 | Murata et al. | 280/632 |
| 4,489,956 | 12/1984 | Jungkind | 280/632 |
| 4,624,473 | 11/1986 | Knabel et al. | 280/632 X |
| 4,773,669 | 9/1988 | Peyre | 280/632 |
| 5,024,457 | 6/1991 | Bogner | 280/632 |

*Primary Examiner*—Charles A. Marmor
*Assistant Examiner*—Michael Mar
*Attorney, Agent, or Firm*—Guido Modiano; Albert Josif

[57] ABSTRACT

A ski fastening includes a rear engagement member provided with a jaw engaging the heel of a boot. The rear engagement member is constituted by a first body which is slidably associated with a base which is rigidly associated with the ski. The first body includes first members associated with the jaw, which can be activated by the boot and activate second members adapted to automatically reset the fastening after a safety release.

9 Claims, 8 Drawing Sheets

1
2
3
4
5
6
7
10
11a
12
13
14
15
16
17
18
19
20
21
22
24a
25a
26
27
28
29
30
31
32
34
II
II

SAFETY FASTENING, PARTICULARLY FOR SKIS

BACKGROUND OF THE INVENTION

Known safety fastenings usable in skis are currently usually constituted by a heel element and by a tip element, both of which are associated with the ski and are adapted for allowing the engagement of the usually standard ends of a ski boot.

Known heel elements in fact usually have a lever provided with a jaw which interacts with the heel region of the boot.

Said heel elements furthermore have means which are adapted to automatically disengage the boot as a consequence of an abnormal force, imparted to the jaw, and exceeding a selected value.

The main disadvantage of these known types of heel element is that, once the disengagement has occurred, the skier must reopen the lever, usually loading one or more springs, in order to be able to fit the boot back into the fastening.

This operation is uneasy because the skier has to either stoop or turn to operate the heel element, for example with a ski-stick.

SUMMARY OF THE INVENTION

The aim of the present invention is therefore to eliminate the disadvantages described above in known types by providing a ski fastening wherein it is possible to rapidly re-associate the boot with said fastening after a disengagement in safety conditions has occurred.

Within the scope of the above aim, an important object is to provide a fastening wherein the skier can secure the boot in an easy manner, without stooping and without acting manually on the heel element directly.

Another important object is to provide a fastening which is structurally simple.

Not least object is to provide a fastening which associates with the preceding characteristics that of being reliable and safe in use.

This aim, the objects mentioned, and others which will become apparent hereinafter, are achieved by a safety fastening, particularly for skis, comprising a rear engagement means provided with a lever, a jaw being associated with said lever and engaging the heel of an item of footwear, characterized in that said rear engagement means is constituted by a first body which is slidably associated with a base, said base being associated with said ski, said lever being transversely pivoted to said base, said first body comprising first means associated with said base, said first means being activated by said item of footwear, said first means cooperating with at least one inclined plane and activating second means adapted to automatically reset the fastening after a safety release.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
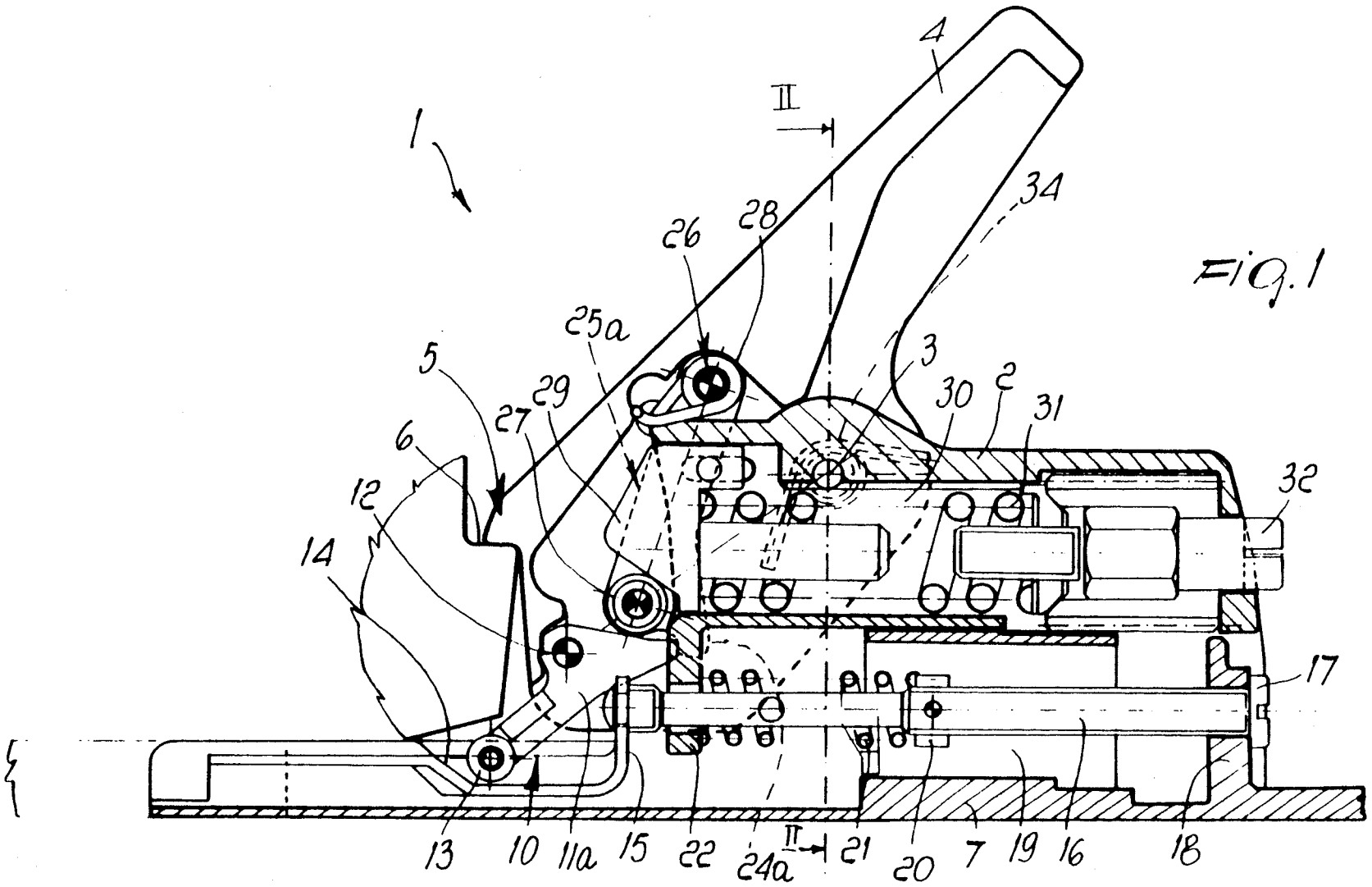
FIG. 1 is a view, taken along a longitudinal median sectional plane, of the heel element in the condition in which the lever is closed.
Figure 3:
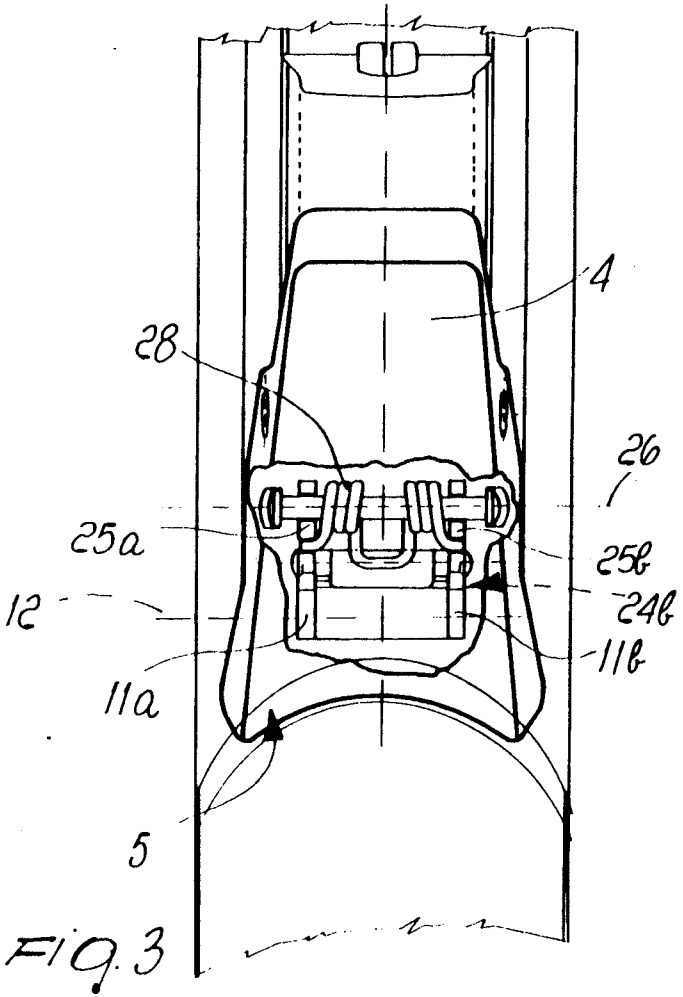
FIG. 3 is a partially sectional top view of the heel element.
Figure 2:
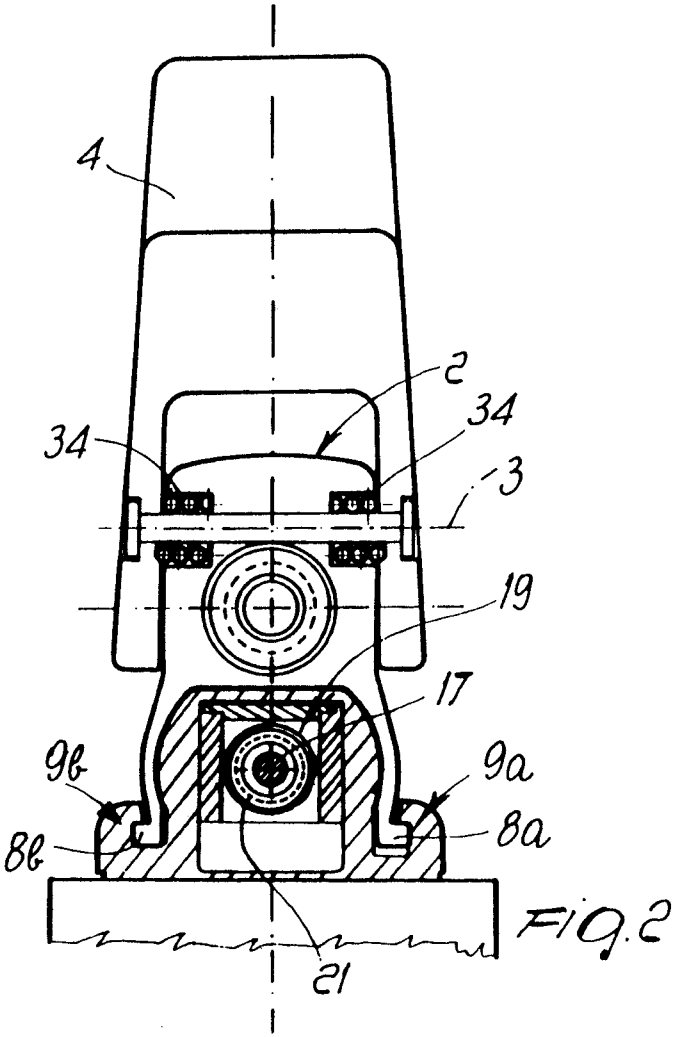
FIG. 2 is a view taken along the sectional plane II—II of FIG. 1.

With reference to FIGS. 1–4, the reference numeral 1 indicates a rear engagement means, hereinafter also termed heel element, of a safety fastening which is constituted by a first body, indicated by the reference numeral 2. A lever 4 is pivoted transversely at a first axis 3, to the first body 2, and has, at one end, a jaw 5 which is associated therewith or formed therein.

Said jaw 5 interacts with the heel 6 of an item of footwear, such as for example a ski boot.

The first body 3 is slidably associated with a second body, or base, 7 which is associated with a ski.

For this purpose, the first body 2 is laterally provided with a pair of first tabs **8*a* and 8*b* which are slidable at correspondingly shaped grooves 9*a* and 9*b* and are defined laterally and longitudinally with respect to the base 7**.

The rear engagement means 1 furthermore comprises first means which are associated with said jaw 5 and are constituted by a pair of pedals 10, optionally connected by a cross-member, each of which has, at its free ends, a head, indicated by the numerals **11*a* and 11*b*, which has a substantially triangular configuration with a vertex directed in the opposite direction with respect to the heel 6 and is pivoted proximate to the base transversely to the jaw 5 at a second axis 12**.

Advantageously, the pedal 10 can have one or more first rollers 13 at the base which connects the wings, said rollers interacting with at least one first inclined plane 14 which is connected, by means of an adapted first tab 15, to the end of a first adjustment screw 16. The head 17 of the screw 16 is rotatably associated at an adapted threaded hole defined on a wall 18 which protrudes rearward with respect to the base 7.

A small cylinder 20 is associated at the stem of the first screw 16 inside a first cavity 19 arranged above said base 7, and a first spring 21 abuts thereon; at its other end, said spring interacts with a second tab 22 of said first body 2 which protrudes in the direction of the base 7 and has a bore for the passage of the first screw 16.

Said second tab 22 is interposed between the end of the first screw 16 which is connected to the first tab 15 and the cylinder 20.

Said first screw 16 allows to adapt the fastening to the length of the sole of the item of footwear, by moving the first body 2 backward, thus increasing the interspace for the mating of the sole with the fastening.

The presence of the first spring 21 allows the elastic recovery of the rear engagement means 1.

Figure 4:
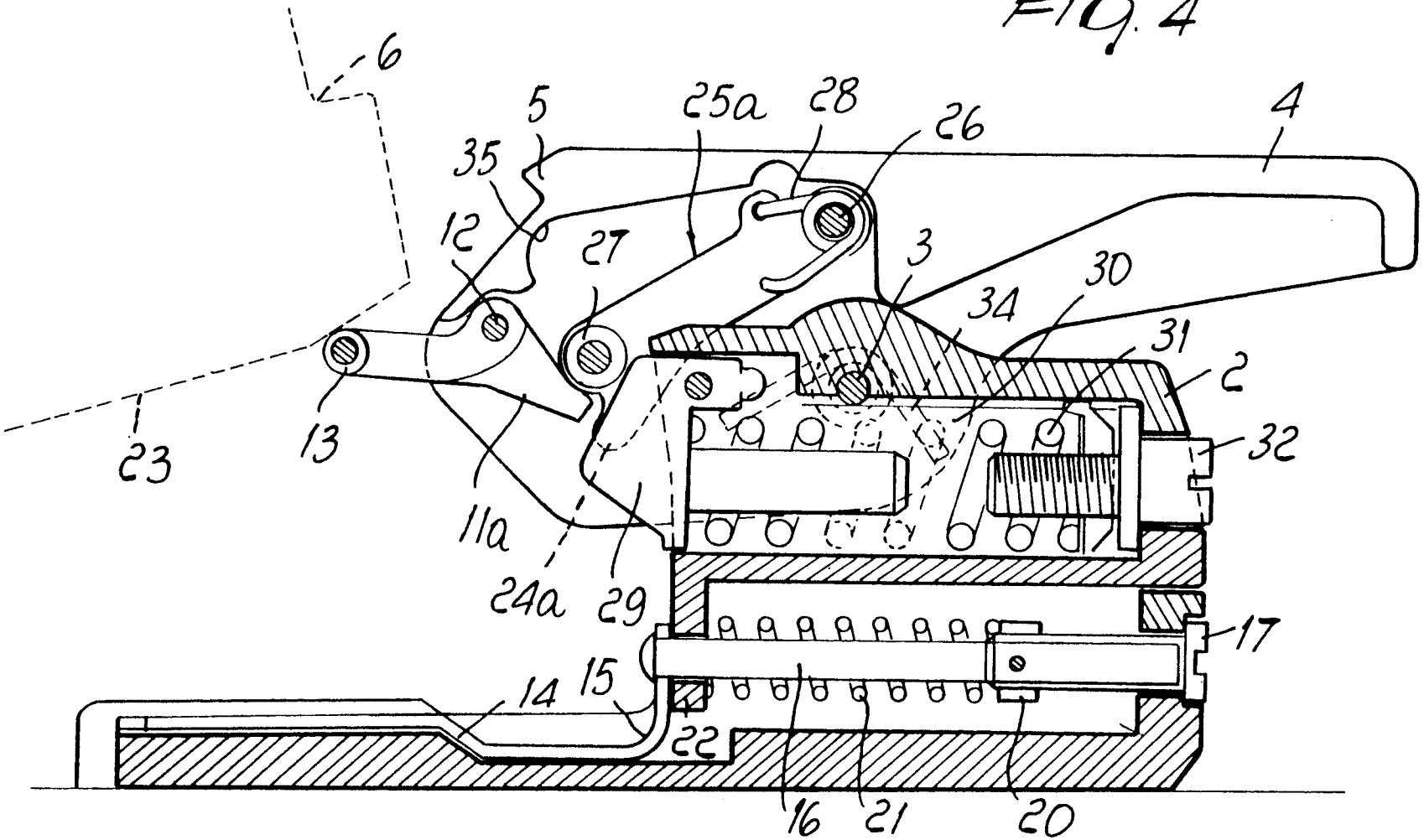
FIG. 4 is a view, similar to that of FIG. 1, of the heel element in the open condition.

The pedal 10 protrudes beyond the jaw 5 and in the condition in which the lever is open, as illustrated in FIG. 4, it can be activated directly by the sole 23 of the item of footwear.

The ends of the head 11*a* and 11*b* of the pedal 10 interact with an adapted pair of lugs 24*a* and 24*b* which protrude below a pair of connecting rods 25*a* and 25*b* which are freely pivoted, at the other end, at an adapted third axis 26, to the jaw 5 or to the lever 4.

Proximate to each lug 24*a* and 24*b*, on each of said connecting rods 25*a* and 25*b*, there are second rollers 27 which slidably interact with an underlying side of the heads 11*a* and 11*b* of the pedal 10.

A second spring 28 is arranged coaxially at the third axis 26 and coaxially to the pivot for the pivoting of the pair of connecting rods 25*a* and 25*b* to the jaw 5 or to the lever 4, and abuts at the underlying first body 2; said second spring 28 is loaded during the last portion of the counterclockwise rotation which can be imparted to the pair of connecting rods 25*a* and 25*b*, as described hereinafter.

The rear engagement means 1 furthermore comprises a cam 29 which is accommodated within an adapted second cavity 30 which is defined inside the first body 2 which lies above the first cavity 19.

A third spring 31 abuts inside the second cavity 30 at the cam 29 and controls, by virtue of the adjustment of a second screw 32 which can be accessed outside the first body 2, the release of the item of footwear in limit conditions from the rear engagement means 1.

The cam 29 furthermore interacts directly with the ends of the pair of connecting rods 25*a* and 25*b* which bear the second rollers 27.

The rear engagement means 1 furthermore comprises, at the first axis 3 for the pivoting of the lever 4 to the first body 2, a fourth spring 34 for contrasting the closure of the jaw 5 and/or of the lever 4.

The operation of the rear engagement means 1 is therefore as follows: considering the position illustrated in FIG. 1, and therefore when the lever 4 is closed and the item of footwear is associated with the fastening, the first body 2 advances with respect to the base 7 consequent to a stress which causes a safety release.

Said advancement occurs due to the pressure imparted by the first spring 21, which forces the second tab 22 into abutment with the first wing 15.

During the forward sliding, the pedal 10, due to its interaction with the inclined plane 14, rotates at the second axis 12, thus releasing the lugs 24*a* and 24*b*.

The pair of connecting rods 25*a* and 25*b* is therefore consequently free to rotate at the third axis 26, thus unloading the second spring 28 and simultaneously allowing the rotation of the jaw 5 at the first axis 3.

The rotation of the pair of connecting rods 25*a* and 25*b* ends against the facing internal wall 35 of the jaw 5.

During this rotation, the second spring 28 furthermore unloads completely until it separates from the underlying first body 2 and thus rotates together with the pair of connecting rods 25*a* and 25*b*.

The rotation of the jaw 5 instead continues up to the complete opening thereof due to the third spring 34, making the cam 29 pass beyond the pair of connecting rods 25*a* and 25*b*.

These last, during the step of complete opening, move away from the internal wall 35 of the jaw 5 simply by gravity, since they are no longer subjected to the effect of the second spring 28.

The rear engagement means is thus ready to be engaged with the boot again.

In order to close the fastening it is in fact sufficient to move the heel of the item of footwear at the pair of pedals 10, or at the cross-member which connects them, imparting thereto a movement toward the ski until said heel is engaged at the jaw 5.

In this manner, the third spring 31 does not contrast the first step of the rotation, since the pair of connecting rods 25*a* and 25*b* does not press at the cam 29, because the lugs 24*a* and 24*b* and the ends of the heads 11*a* and 11*b* of the pedal 10 are not mutually engaged.

The only reaction to be overcome in this step, is therefore exclusively that of the fourth springs 34 (for the rotation of the jaw 5) and of the first spring 21 (rearward movement of the first body 2).

The second step of the closure begins at a given angular position of the jaw 5; the ends of the heads 11*a* and 11*b* of the pedal 10 abut at the lugs 24*a* and 24*b*, and the reaction of the third spring 31 intervenes since the pair of connecting rods 25*a* and 25*b* moves rigidly with the jaw 5 and the pedal 10, pressing against the cam 29.

It has thus been observed that the invention has achieved the intended aim and objects, a safety fastening having been obtained wherein the rear engagement means has the peculiarity of having automatic resetting, i.e. the ability to open consequent to a safety release so as to be ready to subsequently accommodate the item of footwear to be engaged.

The skier can thus re-engage the boot in a rapid and easy manner and without acting manually directly on the lever and therefore without having to stoop.

The ski fastening according to the invention is naturally susceptible to numerous modifications and variations, all of which are within the scope of the same inventive concept.

FIGS. 5–9 show in fact a fastening according to a further aspect of the invention, wherein the reference numeral 101 indicates a rear engagement means, hereinafter also termed heel element, which comprises a first body, indicated by 102, to which a jaw 104 is pivoted at a first pivot 103.

The jaw 104 interacts with the heel 105 of an item of footwear, such as for example a ski boot.

The first body 102 is slidingly associated with a second body 106 which is associated with a ski 107.

The first body 102 of the rear engagement means 101 comprises first means constituted by a pair of first pawls 108 which are identical and are arranged mutually parallel; each pawl is associated, at one end, with the first body 102 at a same second pivot 109.

A first guiding slot 110 for a pair of third pivots 111 is defined longitudinally in the body of each of the first pawls 108; third pivots 111 protrude, along a same axis which is transverse with respect to the ski, from a pair of shoulders 112 which are rigidly associated or are integral with second body 106.

Each of the third pivots 11 furthermore engages a second slot 113 which is defined laterally to the first body 102 along an axis which is longitudinal with respect to the ski.

A first, second and third tooth respectively indicated by the numerals 114, 115 and 116, protrude from each of the first pawls 108 toward the jaw at the end not affected by the second pivots 109.

The ends of the mutually parallel wings 117*a* and 117*b* of second means, constituted by an essentially U-shaped second pawl 118, can be selectively arranged between the first tooth 114 and the second tooth 115 of each of said first pawls 108.

Second pawl 118 is pivoted to the jaw 104 by means of a fourth pivot 119 which is arranged transversely to said wings 117*a* and 117*b* proximate to the cross-member 120 which connects said wings.

Cross-member 120 is accommodated within an adapted cavity 121 defined on the jaw 104 so that it can oscillate within the cavity by virtue of the presence of a first spring 122 which is coaxial to the third pivot 119 and the ends whereof interact with cross-member 120 and with a wall 123 of the cavity 121.

A fourth tooth 124 furthermore protrudes proximate to the ends of the wings 117*a* and 117*b* of the second pawl 118 in the opposite direction with respect to the ski 107.

The second pawl 118 interacts, at the fourth tooth 124, with third means which are constituted by a pair of third pawls 125 which are mutually parallel and are pivoted to the jaw 104 at a fifth pivot 126 which is arranged transversely to the jaw.

Each of the third pawls 125 is arranged in a region above the interacting ends of the pair of first pawls 108 and of the second pawl 118 and has a curved perimetric edge 127 which blends with a fifth tooth 128 which protrudes therefrom and arranges itself, in the engagement condition, between the ends of the wings 117*a* and 117*b* of the second pawl 118 and the first tooth 114 and the second tooth 115 of the pair of first pawls 108, between the fourth tooth 124 of the second pawl 118 and the third tooth 116 of the pair of first pawls 108.

Figure 5:
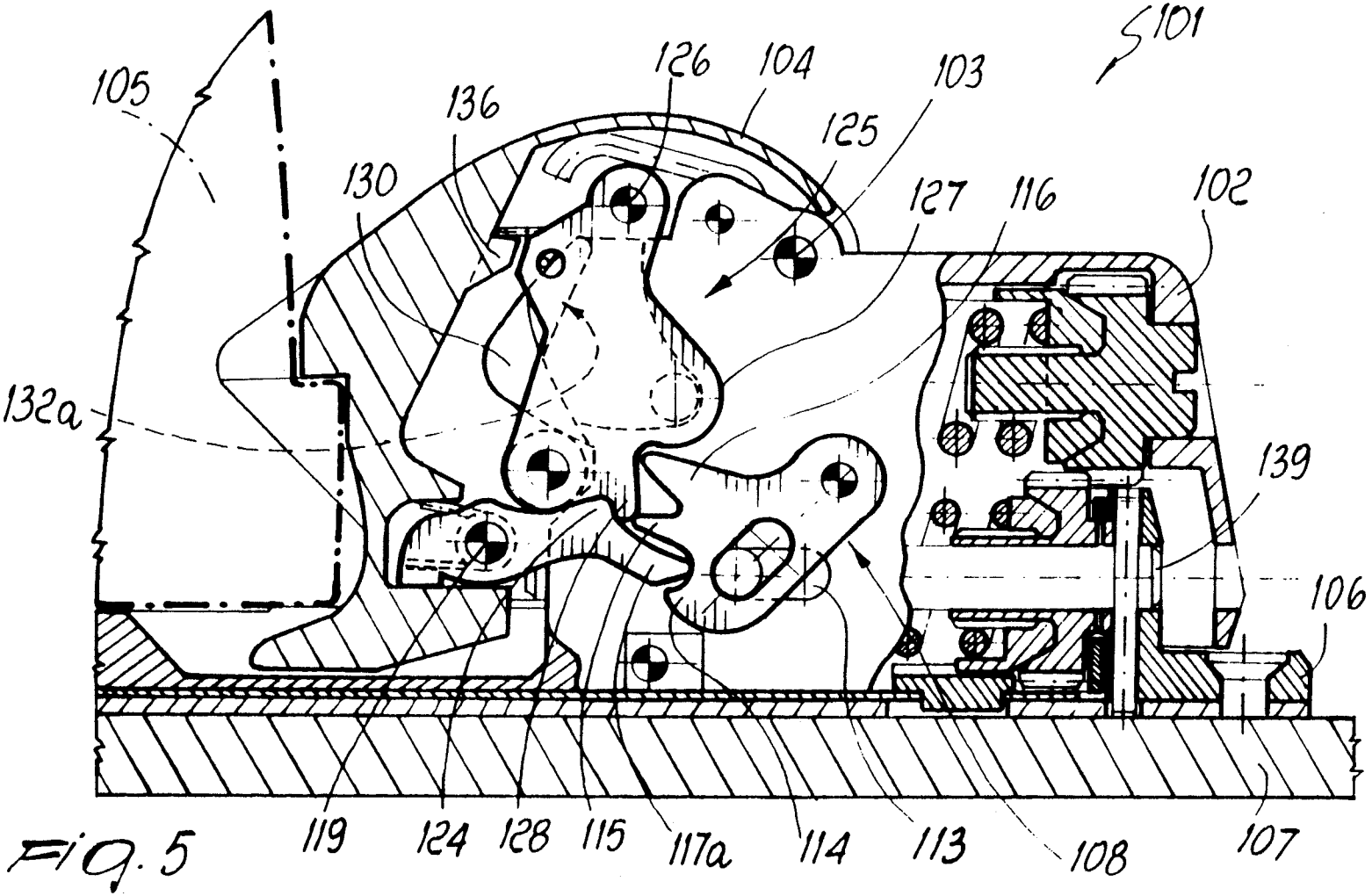
FIG. 5 is a side sectional view, similar to FIG. 1, of a heel element according to a second aspect of the invention.
Figure 8:
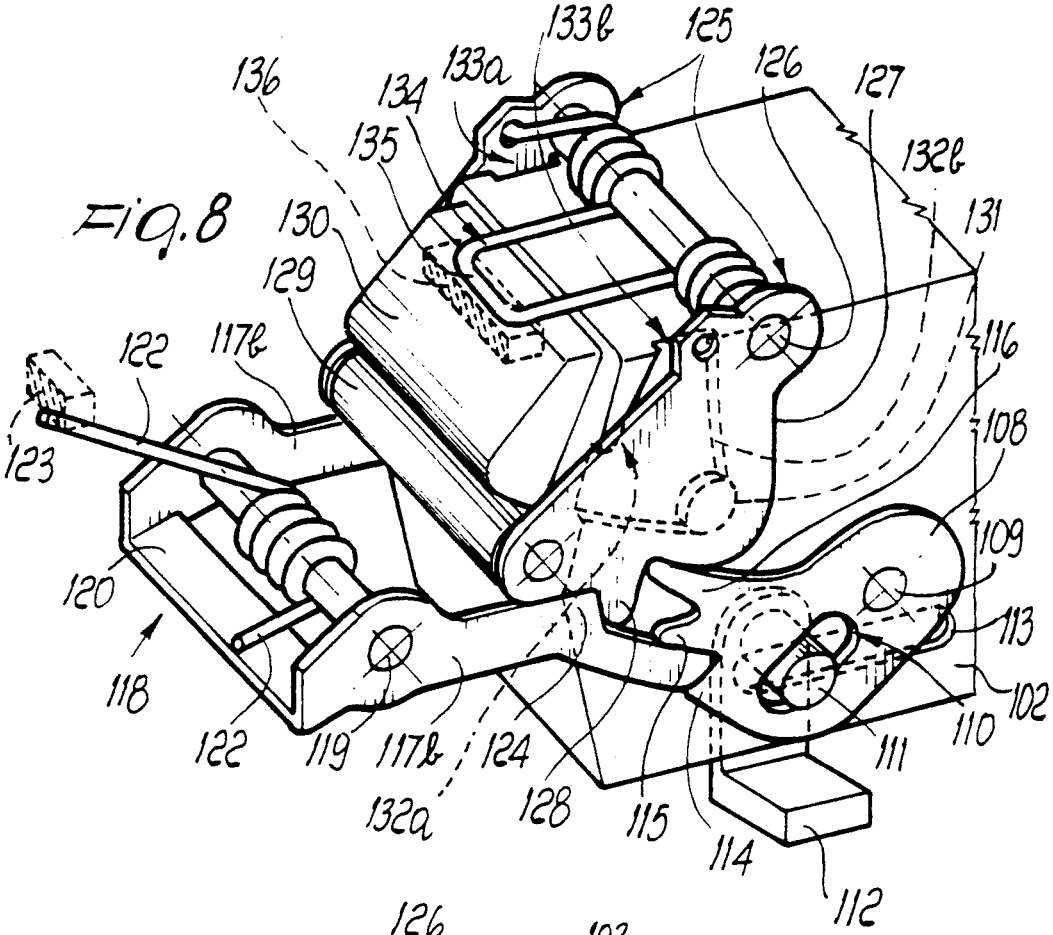
FIG. 8 is an isometric partial view of the heel element of FIG. 5.

This condition is illustrated in FIGS. 5 and 8 of the accompanying drawings.

A transverse roller 129 is furthermore arranged between the third pawls 125, at the end which does not interact with the fifth pivot 126 and is adjacent to the fifth tooth 128, and interacts with a cam 130 which can move axially with respect to the first body 102 and is arranged above the roller 129 when the first pawls 108, the third pawls 125 and the second pawl 118 interact.

Each pair of third pawls 125 furthermore has, in the interspace comprised between the fifth pivot 126 and the fifth tooth 128, a cylindrical lug 131 which protrudes toward the adjacent first body 102 and interacts, during the closure and maximum opening steps of the jaw 104, with a first guiding surface 132*a* and with a second guiding surface 132*b* which are defined at a pair of recesses 133*a* and 133*b* defined on the lateral surface of the first body 102.

The end of a second spring 134 is associated with each of said third pawls 125, is arranged partially coaxially with respect to the fifth pivot 126 and has a loop 135 which abuts at an adapted step 136 defined inside the jaw 104.

Figure 9:
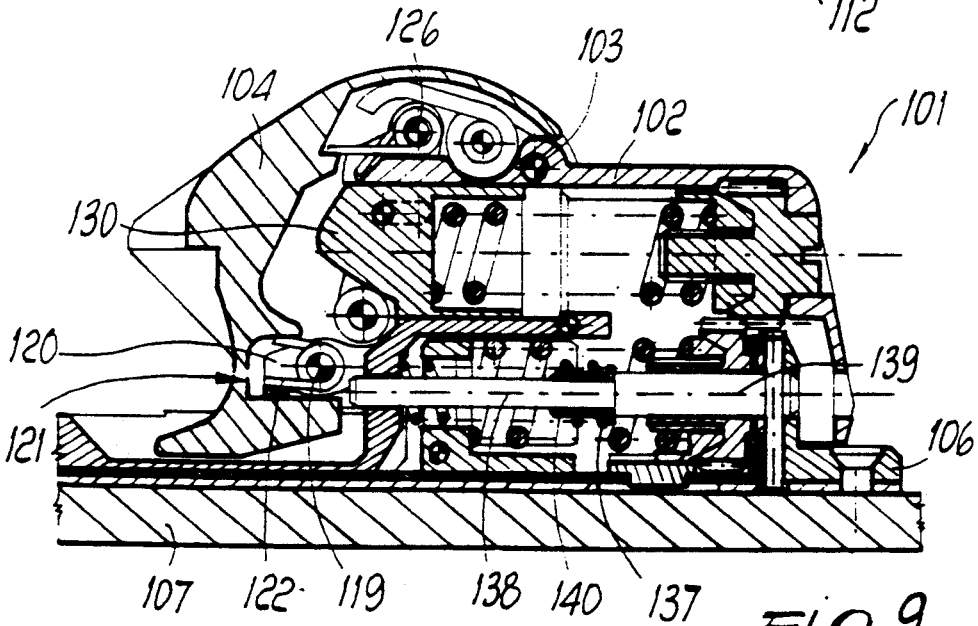
FIG. 9 is a further side sectional view of the heel element of FIG. 5.

The operation of the fastening illustrated in FIGS. 5–9 is as follows: starting from the condition in which the boot 105 is engaged and the heel element is closed, as illustrated in FIG. 5, the heel of the boot keeps the first body 102 in a rearward position, overcoming the reaction of a third spring, for elastic recovery, indicated by 137 in FIG. 9 and arranged coaxially to the stem 138 of a screw 139; the screw is fixed to the second body 106 at one end, whereas the third spring 137 is interposed between a wall of the first body 102 and a sleeve 140 which is rigidly associated coaxially to said stem 138.

In this condition, the pair of first pawls 108 and of third pawls 125 and the second pawl 118 are mutually engaged; the pair of third pawls 125 is in fact retained by the second pawl 118 by means of the engagement of the fourth tooth 124 with the fifth tooth 128, whereas the pair of first pawls 108 is retained by the pair of third pivots 111.

Figure 6:
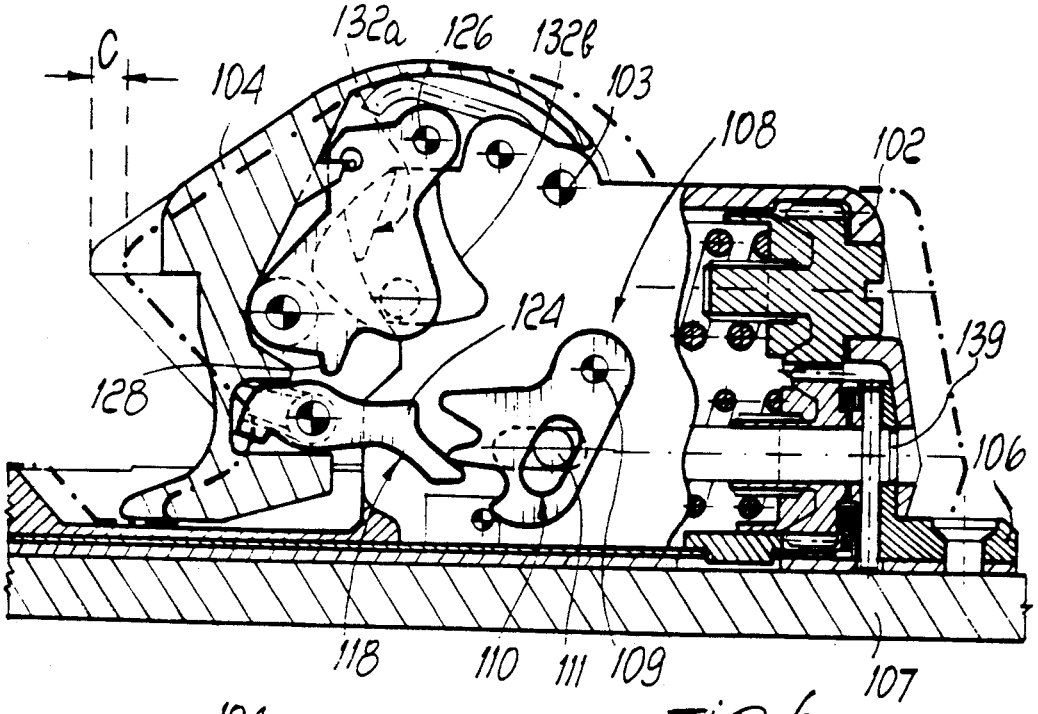
FIG. 6 is a view similar to the preceding one showing the intermediate condition.

In a second instantaneous step, illustrated in FIG. 6, as a consequence of the disengagement of the heel of the boot, due to a safety release, the first body 102, which can move with respect to the ski, moves forward toward the tip of the ski by an amount equal to the stroke C until it abuts on the second body 106, which is fixed.

The second step instantaneously illustrates the condition following the release of the boot which precedes the opening of the jaw 104.

During this step, the second pivot 109 and the second slot 113 move rigidly with the first body 102, whereas third pivots 111 remain motionless, causing the rotation of first pawls 108 about the second pivot 109, which in turn cause the rotation of the second pawl 118 about the fourth pivot 119, in contrast with the first spring 122; the fifth tooth 128 of the pair of third pawls 125 disengages from the fourth tooth 124 of the second pawl 118; by virtue of the second spring 134, the pair of third pawls 125 abuts against the inner surface of the jaw 104.

Figure 7:
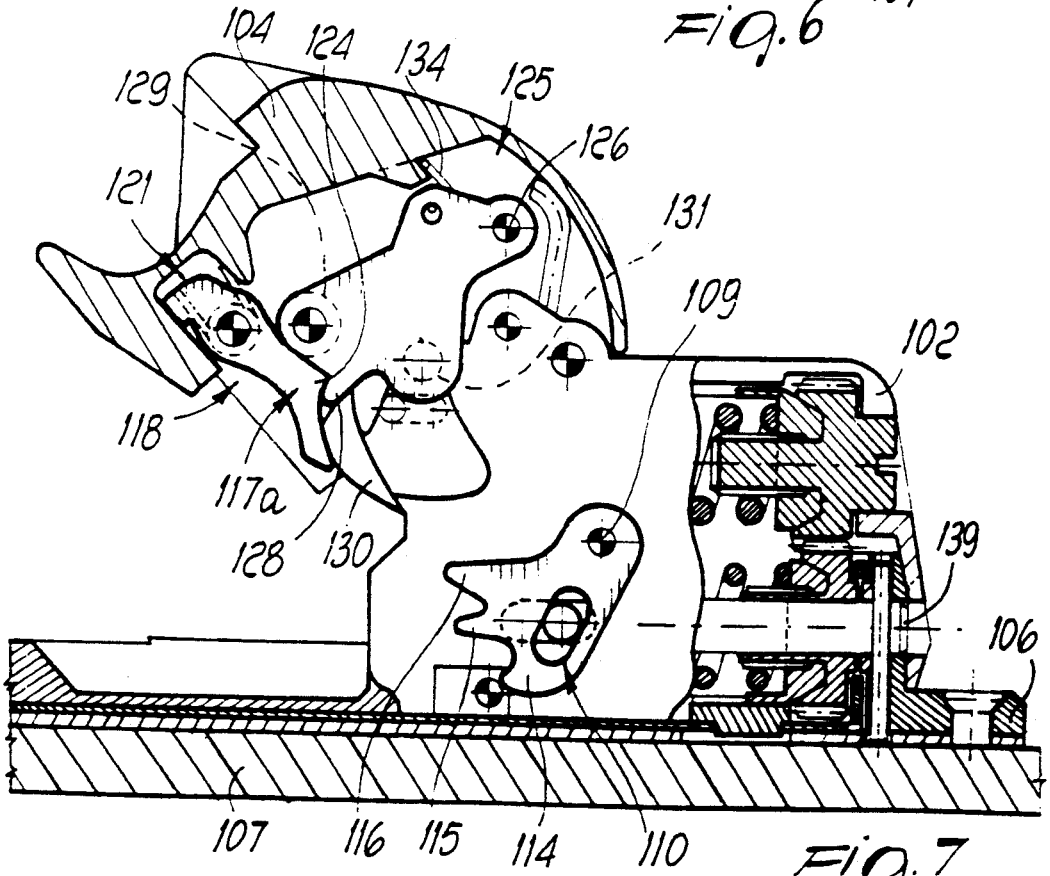
FIG. 7 is a view, similar to FIGS. 5 and 6, showing the jaw in the open condition.

In a third step, illustrated in FIG. 7, the jaw 104 is completely open following a rotation about the first pivot 103.

After complete disengagement from the pair of first pawls 108, the second pawl 118 returns into abutment against the surface of the cavity 121 by virtue of the first spring 122.

The pair of third pawls 125, after passing beyond the cam 130, again engages the fourth tooth 124 of the second pawl 118 by means of the fifth tooth 128, by virtue of the guided sliding of the lug 131 on the guiding surface 132*a*.

In this manner, the second pawl 118 and the pair of third pawls 125 are already reset and ready for the subsequent closure of the jaw 104.

In a subsequent fourth step, starting from the position in which the jaw 104 is fully open, the insertion of the boot produces two simultaneous actions: a first action consists of the rigid rotation of the jaw 104 together with the second pawl 118 and the pair of third pawls 125 toward the pair of first pawls 108; the guiding surface 132*b* allows the lowering of the lug 131.

The second action consists of the backward motion of the first body 102 against the action of the third spring 137, with the consequent repositioning of the pair of first pawls 108, which are thus ready to accommodate the ends of the wings 117*a* and 117*b* of the second pawl 118 between the first tooth 114 and the second tooth 115.

The condition illustrated in FIG. 5, with the jaw closed, is thus reobtained.

FIGS. 10–14 illustrate a heel element 201, according to a third aspect of the invention, which is for the most part similar to the heel element 101 described above.

The heel element 201 comprises a jaw 204 pivoted to a first body 202 and adapted to engage a heel 205 of a boot. The first body 202 is slidingly associated with a second body 206 associated with a ski 207.

One first pawl 208, for each side of the heel element, is pivoted to the sliding first body 202 and is adapted to engage a pair of pivots 211. Pivots 211 are associated with the fixed second body 206 and are arranged at the first guide slots 210.

One second pawl 218 for each side of the heel element 201, is pivoted to the jaw 204 and has a tooth 224. A spring 222 biases each tooth 224 of pawls 218 to engage a seat 228 formed on each of a pair of third pawls 225 pivoted to the jaw 204.

Third pawls 225 are pivoted to the jaw 204 at pivot 226 and engage pawls 218 in the conditions of maximum aperture and closure.

A roller 229 is associated with pawls 225 and is adapted to engage a cam 230 arranged above roller 229.

Each third pawl 225 has a cylindrical lug 231 directed toward the inner side and, during the aperture step of the fastening, adapted to engage a guiding surface 232 formed on the sliding first body 202.

A second spring 234 biases third pawls 225 against the inner surface of jaw 204.

A third spring 237 biases the sliding first body 202 toward the front (toward the left in the figures).

The operation of the heel element 201 is as follows.

Figure 10:
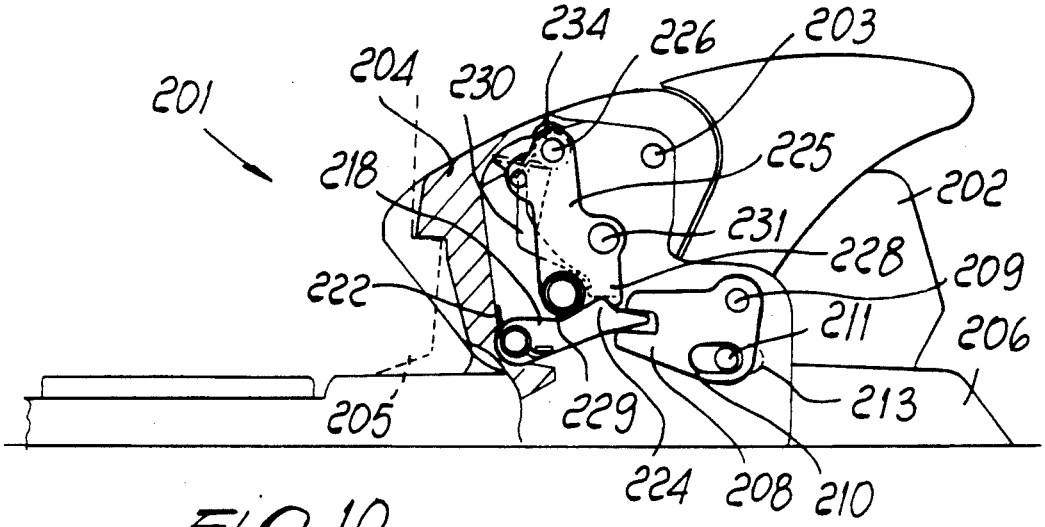
FIG. 10 is a side sectional view, similar to FIG. 5, of a heel element according to a third aspect of the invention.

FIG. 10 shows the fastening in the closed condition with the boot locked.

The heel of the boot keeps the first body 202 in a rear position in contrast with the action of spring 237.

Pawls 208, 218 and 225 are all engaged between one another such that pawls 225 are locked by pawls 218 through the engagement of teeth 224, while pawls 208 are locked by pivots 211.

Figure 11:
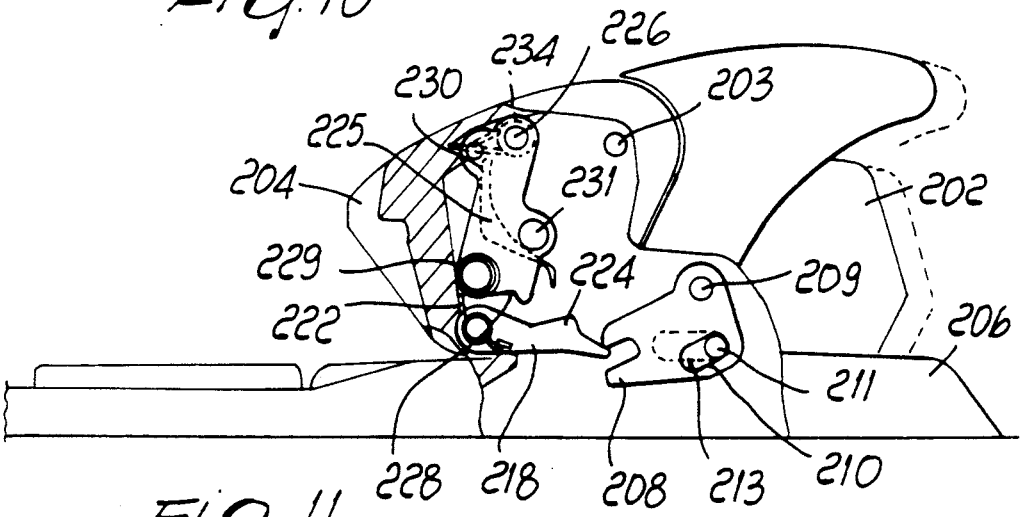
FIG. 11 is a view similar to the preceding one, showing the intermediate condition.

FIG. 11 shows the fastening in the condition of initial aperture of the jaw while the boot is being released.

When the boot is released by a shock or hit, the sliding first body 202 advances, toward the left in the figure, of a distance C, until pivots 211 abut second slots 213 which are formed on the sliding first body 202.

During this step second pivot 209, of pawl 208, moves integral with first body 202, while the fixed pivots 211 i.e. fixed relatively to the ski-engage slots 210. The combination of these movements causes pawls 208 to rotate about pivot 209 and in turn the teeth 224 to rotate because of the force exerted by cam 230 on roller 229 which is connected to the pawls 225.

When the teeth 224 have disengaged from the seats 228, spring 234 biases the pawls 225 to rotate about pivot 226 and to abut the inner surface of the jaw 204.

Figure 12:
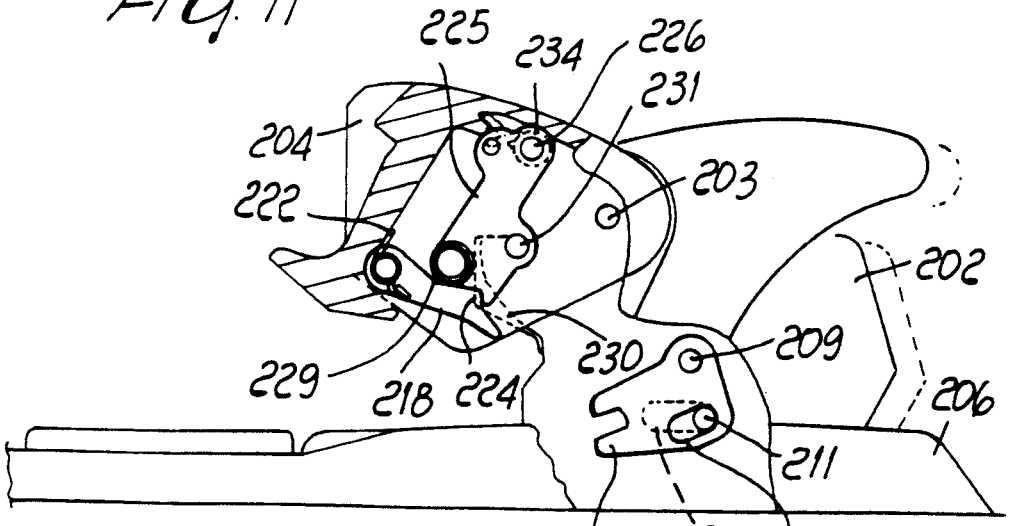
FIG. 12 is a view, similar to FIGS. 10 and 11, showing the jaw in the open condition.
Figure 13:
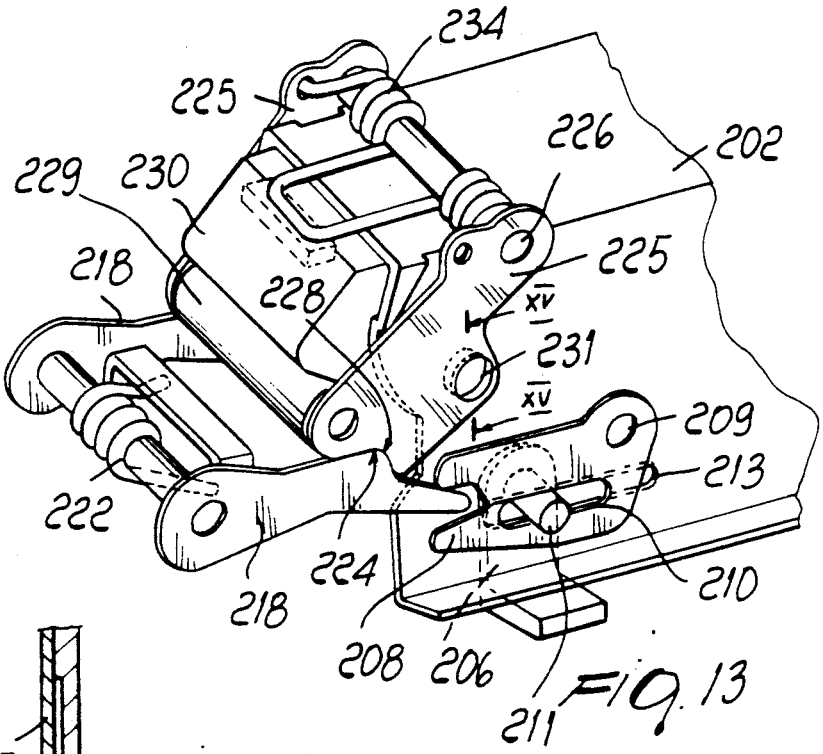
FIG. 13 is an isometric partial view of the heel element of FIG. 10.
Figure 15:
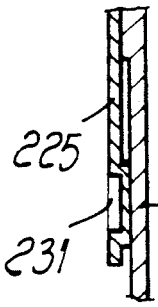
FIG. 15 is a section view according to the line XV—XV of FIG. 13, of a detail of the heel element.
Figure 14:
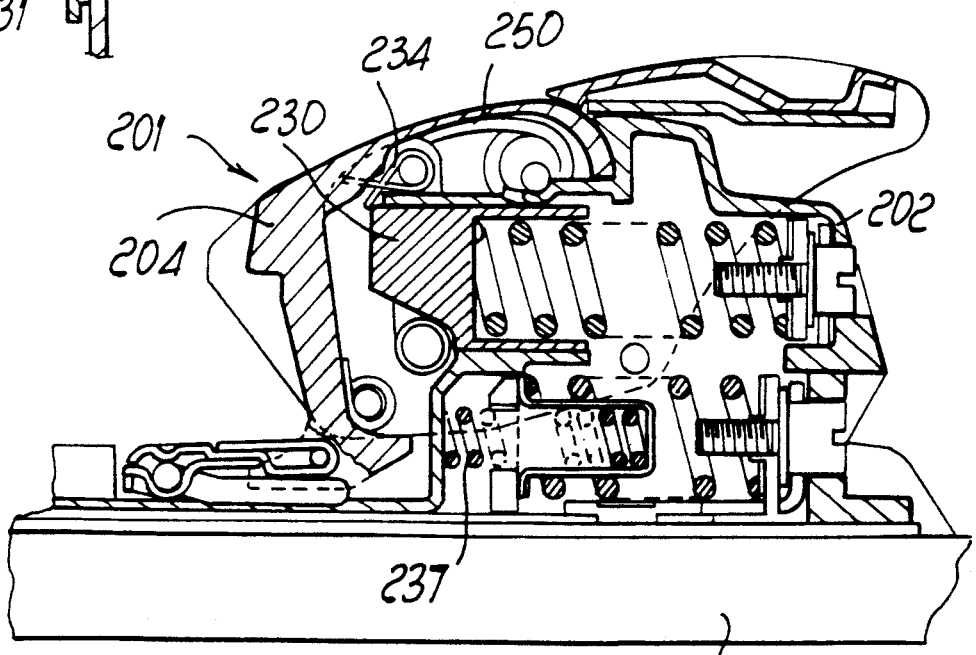
FIG. 14 is a further side sectional view of the heel element of FIG. 10.

FIG. 12 shows the fastening in the condition of being about to complete the opening step.

In this condition, spring 250 causes jaw 204 to rotate about its axis 203 to a position of complete aperture. After the complete disengagement from pawls 208, pawls 218 and 225 again lock together at teeth 224 and seats 228, through the action of first spring 222 and because of the engagement between lugs 231 and surface 232 during the opening step.

Such an engagement allows pawls 218 to correctly engage pawls 225 which are thereby ready for the subsequent closing step.

From the condition of complete aperture, shown in FIG. 12, inserting the boot causes the following simultaneous actions: jaw 204, pawls 218, and pawls 225 rotate integral downward; first body 202 moves backward—to the right of the drawing—against spring 237, and pawls 208 are again set to the normal position ready to accept pawls 218. In this manner the original condition shown in FIG. 10 is again reached.

The fastening illustrated in FIGS. 10–15 has the advantage to allow small longitudinal movements of the heel element during skiing.

The materials and the dimensions which constitute the individual elements of the invention may naturally be the most pertinent according to the specific requirements.

We claim:

1. Safety fastening, particularly for skis, comprising a rear engagement means having a jaw pivoted at a first pivot thereto and adapted to engage the heel of an item of footwear, said rear engagement means comprising a first body which is slidingly associated with a second body which is rigidly associated with said ski, said first body comprising first means adapted to cooperate with second means associated with said jaw and adapted to allow an automatic resetting of said fastening after a safety release, wherein said first means comprise at least one first pawl which is associated, at one end, with said first body at a second pivot, a first guiding slot for at least one third pivot being defined longitudinally on the body of said first pawl, said third pivot protruding, transversely to said ski, from at least one shoulder which is rigidly associated with said second body, said third pivot engaging a second slot which is defined laterally to said first body along an axis which is longitudinal to said ski.

2. Fastening according to claim 1, wherein said first body is laterally provided with a pair of first tabs which are slidable at correspondingly shaped grooves defined laterally and longitudinally to said second body.

3. Fastening according to claim 1, wherein a first tooth, a second tooth and a third tooth protrude from said first pawl toward said jaw and at the end which is not affected by said second pivot, said second means comprising a substantially U-shaped pawl, having a cross-member and wings which can be selectively arranged between said first and second teeth of said first pawl, said second pawl being pivoted to said jaw by means of a fourth pivot.

4. Fastening according to claim 1, wherein a first tooth, a second tooth and a third tooth protrude from said first pawl toward said jaw and at the end which is not affected by said second pivot, said second means comprising a substantially U-shaped pawl, having a cross-member and wings which can be selectively arranged between said first and second teeth of said first pawl, said second pawl being pivoted to said jaw by means of a fourth pivot, said cross-member being accommodated within a cavity which is defined on said jaw so that it can oscillate therein by virtue of a first spring which is arranged coaxially to said third pivot and the ends whereof interact with said cross-member and with a wall of said cavity, a fourth tooth protruding in the opposite direction with respect to said ski proximate to the ends of said wings of said second pawl.

5. Fastening according to claim 1, wherein a first tooth, a second tooth and a third tooth protrude from said first pawl toward said jaw and at the end which is not affected by said second pivot, said second means comprising a substantially U-shaped pawl, having a cross-member and wings which can be selectively arranged between said first and second teeth of said first pawl, said second pawl being pivoted to said jaw by means of a fourth pivot, said cross-member being accommodated within a cavity which is defined on said jaw so that it can oscillate therein by virtue of a first spring which is arranged coaxially to said third pivot and the ends whereof interact with said cross-member and with a wall of said cavity, a fourth tooth protruding in the opposite direction with respect to said ski proximate to the ends of said wings of said second pawl, said second pawl interacting, at said fourth tooth, with at least a third pawl pivoted to said jaw at a fifth pivot which is arranged transversely with respect to said jaw.

6. Fastening according to claim 1, wherein a first tooth, a second tooth and a third tooth protrude from said first pawl toward said jaw and at the end which is not affected by said second pivot, said second means comprising a substantially U-shaped pawl, having a cross-member and wings which can be selectively arranged between said first and second teeth of said first pawl, said second pawl being pivoted to said jaw by means of a fourth pivot, said cross-member being accommodated within a cavity which is defined on said jaw so that it can oscillate therein by virtue of a first spring which is arranged coaxially to said third pivot and the ends whereof interact with said cross-member and with a wall of said cavity, a fourth tooth protruding in the opposite direction with respect to said ski proximate to the ends of said wings of said second pawl, said second pawl interacting, at said fourth tooth, with at least a third pawl pivoted to said jaw at a fifth pivot which is arranged transversely with respect to said jaw, a transverse roller being arranged between said third pawl at the end which does not interact with said fifth pivot and is adjacent to said fifth tooth, said roller interacting with a cam which can move axially with respect to said first body and is arranged above said roller in the condition in which said first and third pawls and said second pawl interact.

7. Fastening according to claim 1, wherein a first tooth, a second tooth and a third tooth protrude from said first pawl toward said jaw and at the end which is not affected by said second pivot, said second means comprising a substantially U-shaped pawl, having a cross-member and wings which can be selectively arranged between said first and second teeth of said first pawl, said second pawl being pivoted to said jaw by means of a fourth pivot, said cross-member being accommodated within a cavity which is defined on said jaw so that it can oscillate therein by virtue of a first spring which is arranged coaxially to said third pivot and the ends whereof interact with said cross-member and with a wall of said cavity, a fourth tooth protruding in the opposite direction with respect to said ski proximate to the ends of said wings of said second pawl, said second pawl interacting, at said fourth tooth, with at least a third pawl pivoted to said jaw at a fifth pivot which is arranged transversely with respect to said jaw, said third pawl being arranged in a region above the interacting ends of said first pawl and of said second pawl, said third pawl having a curved perimetric edge which blends with a fifth tooth which protrudes therefrom and arranges itself, in the condition in which the ends of said wings of said second pawl and said first and second teeth of said first pawls are engaged, between said fourth tooth of said second pawl and said third tooth of said first pawl, said third pawl having, in the interspace comprised between said fifth pivot and said fifth tooth, a cylindrical lug which protrudes toward said adjacent first body, said lug interacting, during the steps of closure and maximum opening of said jaw, with at least one guiding surface which is obtained at at least one recess defined on the lateral surface of said first body.

8. Fastening according to claim 1, wherein a first tooth, a second tooth and a third tooth protrude from said first pawl toward said jaw and at the end which is not affected by said second pivot, said second means comprising a substantially U-shaped pawl, having a cross-member and wings which can be selectively arranged between said first and second teeth of said first pawl, said second pawl being pivoted to said jaw by means of a fourth pivot, said cross-member being accommodated within a cavity which is defined on said jaw so that it can oscillate therein by virtue of a first spring which is arranged coaxially to said third pivot and the ends whereof interact with said cross-member and with a wall of said cavity, a fourth tooth protruding in the opposite direction with respect to said ski proximate to the ends of said wings of said second pawl, said second pawl interacting, at said fourth tooth, with at least a third pawl pivoted to said jaw at a fifth pivot which is arranged transversely with respect to said jaw, said third pawl being arranged in a region above the interacting ends of said first pawl and of said second pawl, said third pawl having a curved perimetric edge which blends with a fifth tooth which protrudes therefrom and arranges itself, in the condition in which the ends of said wings of said second pawl and said first and second teeth of said first pawls are engaged, between said fourth tooth of said second pawl and said third tooth of said first pawl, the end of a second spring is associated with said third pawl, said spring being arranged partially coaxially to said fifth pivot and having a loop which abuts at an adapted step defined inside said jaw.

9. Fastening, according to claim 1, wherein, when said fastening is in a closed condition, engaging said heel of said item of footwear, said first guiding slot is parallel to said second slot, said pivot being adapted to move slightly in said slots during skiing.

* * * * *